United States Patent [19]

Baumann

[11] Patent Number: 4,657,052

[45] Date of Patent: Apr. 14, 1987

[54] DEVICE TO ALTER THE DISTANCE BETWEEN THE FRAME STAVE OF A HEALD FRAME AND THE HEALD CARRYING ROD HELD BY ROD HOLDERS ON THE FRAME STAVE

[75] Inventor: Hans Baumann, Horgen, Switzerland

[73] Assignee: Grob & Co. Aktiengesellschaft, Horgen, Switzerland

[21] Appl. No.: 767,842

[22] Filed: Aug. 21, 1985

[30] Foreign Application Priority Data

Sep. 10, 1984 [DE] Fed. Rep. of Germany ..... 3433181

[51] Int. Cl.[4] ..... D03C 9/06; F16B 1/00

[52] U.S. Cl. ..... 139/92; 403/4

[58] Field of Search ..... 139/92, 91, 82, 88, 139/57, 58; 403/4, DIG. 7

[56] References Cited

U.S. PATENT DOCUMENTS 4,112,980 9/1978 Bader ..... 139/92

4,249,579 12/1981 Baumann et al. ..... 139/92

FOREIGN PATENT DOCUMENTS 496094 12/1976 Australia ..... 403/4

*Primary Examiner*—James Kee Chi

*Attorney, Agent, or Firm*—Watson, Cole, Grindle & Watson

[57] ABSTRACT

On the frame stave (1) of a heald frame there is by means of a rod holder (5) a heald carrying rod (6) arranged in such a way that its distance to the frame staves (1) can be changed. An eccentric ring (10) with a polygon shaped outer circumference engages for this purpose in a rectangularly shaped recess (7) provided in the rod holder (5). The eccentric ring (10) is securely connected against free rotation with an intermediate element consisting of a concentric ring (11) and a center core (12) which is securely connected against free rotation. The center core together with its concentric ring (11) is seated in a bore provided in the frame stave (1) by means of each one appropriate configured shoulder (21) and the external toothing (14) configured at the ring (11) is between those shoulders and its outside diameter is larger than the diameter of bore (20) resulting that the teeth of the outer toothing (14) engages securely into the counter part of the eccentric ring (10) and the teeth profiles lodge in the hollow space touching the inside walls for the purpose of securing a displacement of the element in axial direction. The concentric ring (11) possesses a partition slit (22) and for that reason it can be inserted from outside into the bore in the frame stave (1) and brought into appropriate position, after the rod holder (5) together with the eccentrical ring (10) was inserted through an opening (4) provided at the frame stave (1). A center core (12) is inserted and securely kept against free rotation in the concentric ring (11) and the complete unit can be rotated resulting in the rotation of the eccentric ring (10) and as a result the rod holder (5) with the heald carrying rod (6) can be moved in relation to the frame stave (1).

5 Claims, 11 Drawing Figures

DEVICE TO ALTER THE DISTANCE BETWEEN THE FRAME STAVE OF A HEALD FRAME AND THE HEALD CARRYING ROD HELD BY ROD HOLDERS ON THE FRAME STAVE

The invention refers to a device to alter the distance between the frame stave of a heald frame and the heald carrying rod held by rod holders on the frame stave. The frame staves, a hollow profile, has an appropriate configured bore in the walls of the profile into which an eccentric element consisting of several parts is seated and can be rotated whereby the periphery or outer circumference of the eccentric portion engages in a recess of the rod holder with the purpose to change the distance of the rod holder in relation to the frame stave, whereby the eccentric element consists of an eccentric ring and with the polygon circumference of it several adjusting positions can be made and which is held securely against free rotations by a center core the latter is held in the bore against free rotation of the frame stave and can however be rotated from outside by suitabel elements.

U.S. Pat. No. 4,249,579 discloses a heald frame with a device of the aforementioned embodiment whereby the eccentric element which can be rotated consists of an eccentric ring with a polygon shaped circumference and of an inner element, a center core, which is secured against free rotation and connected with the former and which is seated and can be rotated in the bore of the frame stave. For obtaining the secure connection against free rotation of the parts the outer polygon shaped circumference of the inner part have to match with the inner circumference of the ring shaped eccentric element whereby the polygon shaped circumference could also be configured as toothing. On the concealed inner part there are appropriate configured shoulders holding the element in the bore in the hollow space of the frame stave whereby the shoulder body of the polygon shaped or the crest of the toothing configured on the outer circumference of the element lodge in the hollow space of the frame stave so that the concealed inner part together with the eccentric ring which is securely connected against free rotation on the circumference of that element and its position is secured against lateral displacement in the hollow space of the frame stave.

This known embodiment is restricted upon the design of the frame stave and the thereupon manner of assembling at which time the outer eccentric ring together with the rod holder has to be inserted through an opening provided on the narrow side of the frame stave facing the heald carrying rod into the hollow space of the stave and the center core has to be pressed from the outside into the bore of the frame stave whereby for reasons of elasticity of the material used for the center core its polygon shaped or crest of the toothing configured on its outer circumference snaps into the eccentric ring placed in the hollow spaced and locks behind the walls of the frame stave into position. In order to carry out this assembling a special device is needed and if all parts are once fitted it is not possible to dismantle the unit without using a special tool or without demolishing one of the parts. Difficulties may arise when for instance a rod holder of a weaving frame which is in operation breaks and has to be replaced by a new one or any other provision of repair will have to be carried out and because the special device for assembling which is used by the manufacturer cannot be put at the disposal to each customer at the time of buying heald frames.

Accordingly an important object of the present invention is to improve the design of connection between the frame stave and the heald carrying rod with the possibility for adjustments of the respective distance in such a way that it is possible to carry out dismantling and reassembling of the parts without the need for mechanical auxiliary devices but that the work can be done manually.

An example of an embodiment of the invention will be understood from the following description of the drawings.

Figure 1:
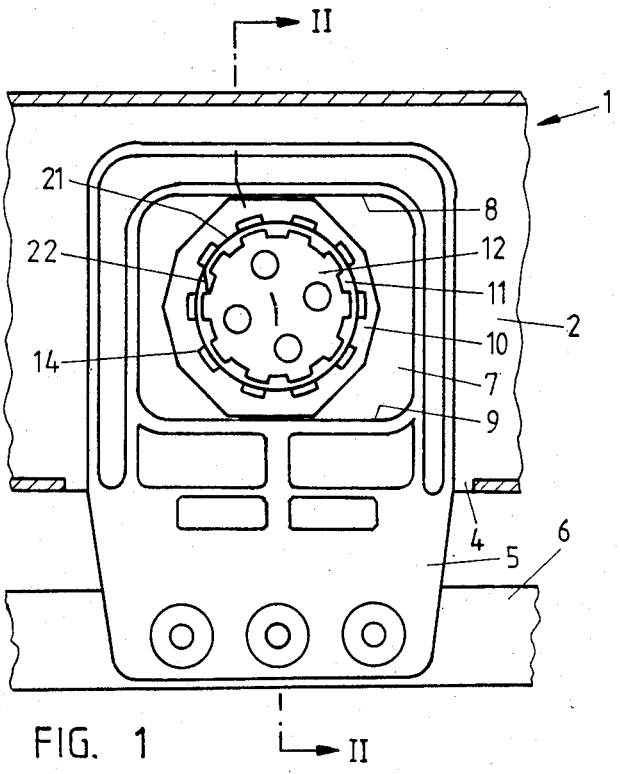
FIG. 1 is a cross-section of a heald frame without the front wall of the frame stave showing the rod holder and the eccentric ring of the invention.
Figure 2:
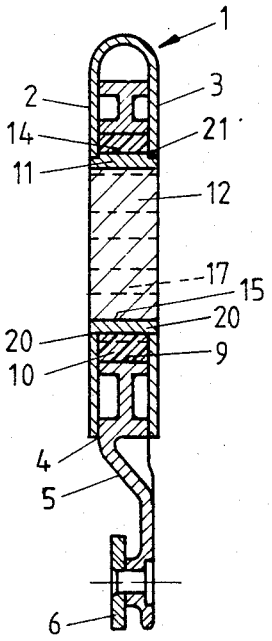
FIG. 2 is a sectional view taken substantially along the line II—II of FIG. 1.
Figure 3:
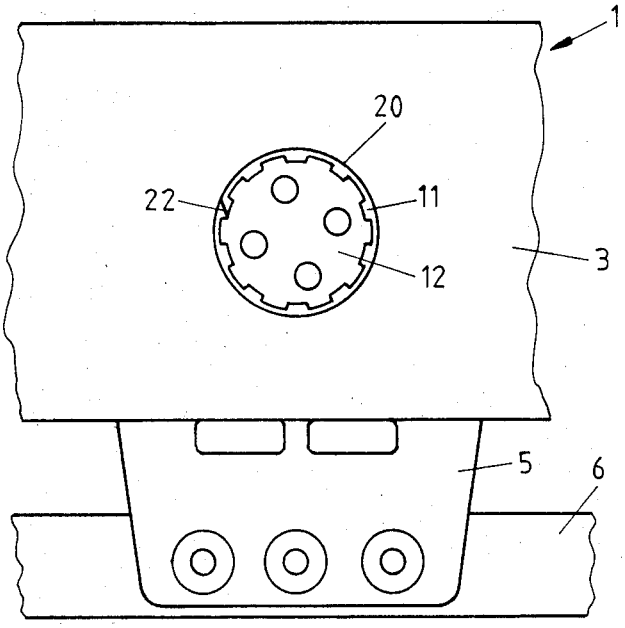
FIG. 3 is a front elevational view of a frame stave similar to FIG. 1 including the front wall.
Figure 4:
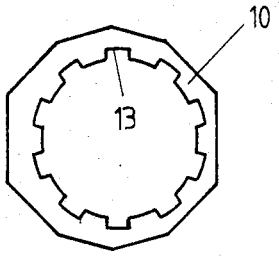
FIGS. 4 and 5 are, respectively, a front view and a side view of the eccentric ring.

In FIGS. 1 to 3 a section of a frame stave 1 configured as a hollow profile is shown having two walls 2 and 3 facing each other. In FIG. 1 the front wall 3 is omitted in order to show the parts which are fitted in the hollow profile. Through an opening 4 provided at the longitudinal narrow side of the frame stave 1 a rod holder 5 is fitted into the hollow profile. Onto the rod holder 5 a heald carrying rod 6 is fastened as illustrated in FIG. 1. The distance of the heald carrying rod in relation to the frame stave has to be adjustable. For this purpose the rod holder 5 is provided with a rectangularly shaped recess 7 such that each part of surfaces 8,9 are parallel and facing one another. The polygon circumference of an eccentric ring 10 which is inserted in the rectangular recess 7 engages with the surfaces 8 and 9. By rotating this eccentric ring 10 the position of the rod holder 5 in relation to the frame stave can be moved up and down. The polygon shaped outer circumference of the eccentric ring 10 permits several different locking positions and as a result the chosen position of ring 10 assures that the distance between the frame stave 1 and the heald carrying rod 6 remains firm. The rotation of the eccentric ring 10 is accomplished by bi-partide elements consisting of a concentric ring 11 and a center core 12. In order to assure a secure connection against free rotation between the eccentric ring 10 and the concentric ring 11 the inner circumference of the eccentric ring 10 is configured with a toothing 13 as illustrated in FIG. 4 which engages with a counter toothing 14, FIG. 6 configured at the outer circumference of the concentric ring 11. This concentric ring 11 is on the other hand also securely connected against free rotation to the center core and is for this purpose on its inner circumference also configured with a toothing 15 which engages in a counter toothing 16 configured on the outer circumference of the center core 12. The center core 12 has four holes 17 for the insertion of a suitable tool to enable rotation of such intermediate elements which are engaged by toothing resulting in the rotation of the eccentric ring 10.

Figure 6:
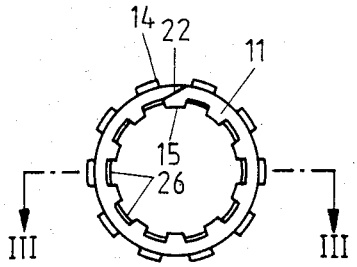
FIG. 6 is a front view of the concentric ring.
Figure 9:
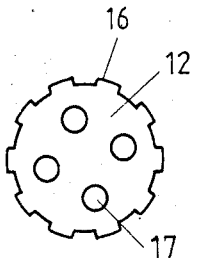
FIGS. 9 and 10 are, respectively, a front view and a side view of the center core.
Figure 5:
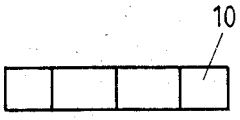
Figure 7:
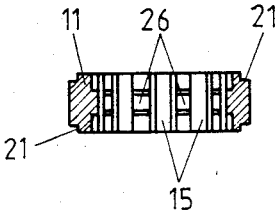
FIG. 7 is a sectional view the concentric ring taken substantially along the line III—III of FIG. 6.
Figure 10:
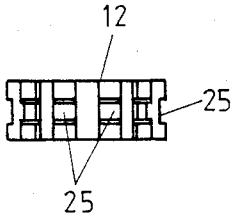
Figure 8:
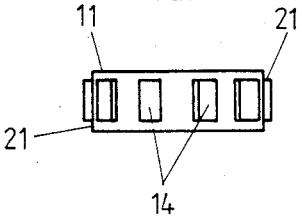
FIG. 8 is a side view of the concentric ring.

The frame stave 1 has in both its walls 2 and 3 a through bore 20 into which the concentric ring 11 is seated by means of two appropriate configured shoulders 21 arranged opposite each other which allows rotating of the concentric ring 11. As illustrated in FIGS. 6 and 8 the width of the teeth of the toothing 14 configured at the outer circumference on the concentric ring 11 is less than the width of the ring and in consequence the appropriate configured shoulders 21 on the concentric ring 11 are sealed in the through bore 20 on the frame stave 1. The teeth of the external toothing 14 are therefore lodged within the hollow space of the frame stave 1 and both the end surfaces of the teeth contact the inside of the two walls 2 and 3 of the frame stave. The concentric ring 11 composed of elastic or elastomeric material and as illustrated in FIG. 6 is provided with a partition slit 22 which permits to overlap the ends resulting in a smaller outside diameter facilitating assembly by means of inserting this ring from outside into the bore 20. Prior to that operation the rod holder 5 with the eccentric ring 10 engaging in the rectangular recess was inserted through the opening 4 into the hollow space of the frame stave 1. By spreading or expanding the inserted concentric ring 11 an engagement of the external toothing 14 and the toothing 13 at the inner circumference of the eccentric ring 10 can be achieved whereby the teeth of the toothing 14 configured at the outer circumference of the concentric ring lodges inside the hollow space of the frame stave 1 having a larger circumference than the bore 20. The concentric ring 11 which is provided with a partition slit therefore enables to seat the complete unit consisting of three elements in the bore of the frame stave and to secure the unit against displacement in an axial direction.

The center core 12 is pressed as the last operation in the concentric ring 11 whereby the toothing 15 configured at the inner circumference of the ring engages with the toothing 16 configured at the outer circumference of the center core 12. In order to secure the center core 12 against displacement in axial direction an additional toothing is provided which prevents displacement of the parts from each other. For this purpose the outer tubing 16 configured at the external circumference of the center core 12 has at the middle section of the width of each tooth a recess 25 into which a protrusion 26 configured in each gap between two teeth of the internal toothing 15 of the concentric ring 11 engages thus enabling that all protrusions 26 do engage securely into all recesses 25.

Figure 11:
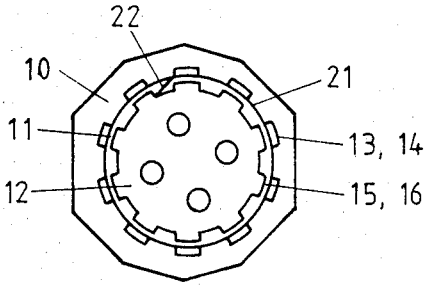
FIG. 11 is a front view of the assembled parts according to FIGS. 4, 6 and 9.

FIG. 11 illustrates the assembled parts according to FIG. 4 to FIG. 10 and from FIG. 3 it is obvious that upon completion of the assemblying, the teeth of the external toothing 14 of the external ring 11 are within the hollow space of the frame stave 1 and are hidden by the wall 3 of the frame stave 1.

I claim:

1. A device for setting the distance between the frame stave of a heald frame and the heald carrying rod, held on the frame stave by rod holders, inserted in an opening of the hollow frame stave, the walls of which having appropriate bores, into which an intermediate element consisting of a ringed straped member and a central member is seated and can be rotated, the ring shaped member having an eccentric whereby the outer circumference with a polygon shape engaging a rectangularly shaped recess in the rod holder whereby the upper and lower surfaces of the recess engage the eccentric ring shaped member securely but can still be rotated by means of the central member, being in mating engagement with the ring shaped member enabling to move the rod holder in relation to the frame stave, wherein the central member comprises a concentric ring (11) and a center core (12) being of elastic material, the concentric ring having a partition slit and both front faces of the ring (11) having appropriate configured shoulders (21) by means of which the concentric ring is kept in the bores (20) of the frame stave (1) and having locking elements (14) on the outer and inner periphery in engagement with the eccentric ring shaped member and the center core (12) which can be rotated by means of a tool.

2. The device according to claim 1, wherein said concentric ring (11) is configured o the outer and inner circumferences with external toothing (14) and internal toothing (15) and the width of the teeth of the toothing (14) configured at the outer circumference of the ring is narrower than the width or the concentric ring (11) in order to form the appropriate configured shoulder (21) by means of which the ring (11) is kept in the bores (20) of the frame stave (1) whereby the crest f the teeth of the toothing (14) configured on the outer circumference of the concentric ring (11) is lodged in the hollow space of the frame stave and does form a larger circumference other than the circumference of the bore (20).

3. The device according to claim 2, wherein the external toothing (14) of the concentric ring (11) shown a partition slit (22) the ends of which can overlap enabling an insertion into the opening of the eccentric ring shaped member (10) and spreading or expanding the inserted concentric ring (11) in the radial direction results in an engagement of the external toothing (14) with the counter toothing (13) configured at the internal circumference of the eccentric ring shaped member (10) and the internal toothing (15) of the concentric ring (11) engage with the counter toothing (16) configured at the external circumference of the center core (12).

4. The device according to claim 3, wherein the internal toothing (15) of the concentric ring (11) and the counter toothing (16) configured on the external circumference of the center core (12) having additionally locking means comprising recesses (25) on the middle section of the width of said counter toothing (16) into which protrusions (26), on the middle section of the with of said internal toothing (15) engage in order to prevent an axial displacement against each other of the concentric ring (11) and the center core (12).

5. The device according to claim 4, wherein the additional locking toothing (24, 26) comprise flat notches (25) in the center section of each tooth at the outer circumference of the toothing (16) of the center core (12) and of protrusions (26) configued in each gap between the teeth of the internal toothing (15) of the concentric ring (11), said protrusions (26) do match into these flat notches (25).

* * * * *